US009713735B2

(12) United States Patent
Lanfranco

(10) Patent No.: US 9,713,735 B2
(45) Date of Patent: Jul. 25, 2017

(54) POLYVALENT APPARATUS FOR PHYSICAL THERAPY

(71) Applicant: Advanced Distribution S.P.A., Leini' (IT)

(72) Inventor: Gianni Lanfranco, Leini' (IT)

( * ) Notice: Subject to any disclaimer, the term of this patent is extended or adjusted under 35 U.S.C. 154(b) by 0 days.

(21) Appl. No.: 14/767,693

(22) PCT Filed: Jan. 29, 2014

(86) PCT No.: PCT/IT2014/000024
§ 371 (c)(1),
(2) Date: Aug. 13, 2015

(87) PCT Pub. No.: WO2014/125513
PCT Pub. Date: Aug. 21, 2014

(65) Prior Publication Data

US 2015/0375033 A1 Dec. 31, 2015

(30) Foreign Application Priority Data

Feb. 14, 2013 (IT) ..... TO13A0126

(51) Int. Cl.
*A63B 21/06* (2006.01)
*A63B 21/00* (2006.01)
(Continued)

(52) U.S. Cl.
CPC ..... *A63B 21/06* (2013.01); *A63B 21/00* (2013.01); *A63B 21/00065* (2013.01);
(Continued)

(58) Field of Classification Search
CPC ..... A62B 21/4011; A62B 21/4013; A62B 21/4015; A62B 21/0434; A62B 21/0421; A62B 21/0428; A62B 21/0435; A62B 21/0442; A62B 21/055; A62B 21/0552; A62B 21/0555; A62B 21/0557; A62B 23/03558; A62B 23/03566; A62B 2225/10; A62B 2225/102; A62B 2225/105; A62B 2225/107; A62B 23/04; A62B 23/0405; A62B 23/08; A62B 23/085; A62B 23/10; A61H 2201/164; A61H 2201/1642; A61H 1/0237; A61H 1/024; A61H 1/0255;
(Continued)

(56) References Cited

U.S. PATENT DOCUMENTS 5,334,120 A * 8/1994 Rasmussen ..... A63B 21/0615 482/101
5,733,233 A * 3/1998 Webber ..... A63B 23/0494 482/100
(Continued)

FOREIGN PATENT DOCUMENTS

DE 20107535 8/2001
EP 0761259 3/1997

*Primary Examiner* — Loan H Thanh
*Assistant Examiner* — Gregory Winter
(74) *Attorney, Agent, or Firm* — Jennifer L. Bales; Macheledt Bales LLP

(57) ABSTRACT

A polyvalent apparatus for physical therapy including a support to which is fastened a first tool provided for a specific treatment, a second and a third tool provided for a specific treatment, the second and the third tool being connected to the support in combination with the first tool.

9 Claims, 6 Drawing Sheets

(51) Int. Cl.

| | |
|---|---|
| ***A63B 21/055*** | (2006.01) |
| ***A63B 21/078*** | (2006.01) |
| ***A63B 23/04*** | (2006.01) |
| ***A63B 23/035*** | (2006.01) |
| ***A63B 23/08*** | (2006.01) |
| ***A63B 21/02*** | (2006.01) |
| *A63B 21/04* | (2006.01) |
| *A63B 23/00* | (2006.01) |
| *A63B 71/02* | (2006.01) |

(52) U.S. Cl.
CPC ..... *A63B 21/02* (2013.01); *A63B 21/0552* (2013.01); *A63B 21/0555* (2013.01); *A63B 21/0557* (2013.01); *A63B 21/078* (2013.01); *A63B 21/154* (2013.01); *A63B 21/159* (2013.01); *A63B 21/4011* (2015.10); *A63B 21/4015* (2015.10); *A63B 21/4031* (2015.10); *A63B 21/4049* (2015.10); *A63B 23/03533* (2013.01); *A63B 23/04* (2013.01); *A63B 23/085* (2013.01); *A61H 2203/045* (2013.01); *A63B 21/00069* (2013.01); *A63B 21/0421* (2013.01); *A63B 21/055* (2013.01); *A63B 21/4029* (2015.10); *A63B 2023/003* (2013.01); *A63B 2071/025* (2013.01); *A63B 2071/027* (2013.01); *A63B 2208/0228* (2013.01); *A63B 2208/0247* (2013.01); *A63B 2208/0252* (2013.01); *A63B 2225/09* (2013.01); *A63B 2225/093* (2013.01)

(58) Field of Classification Search
CPC ..... A61H 1/0266; A61H 2203/0431; A61H 2205/10; A61H 2205/102; A61H 2205/104; A61H 2205/106; A61H 2205/108
See application file for complete search history.

(56) References Cited

U.S. PATENT DOCUMENTS

| | | | | | |
|---|---|---|---|---|---|
| 6,149,554 | A * | 11/2000 | Ferguson | A63B 21/023 | 482/83 |
| 6,482,139 | B1 * | 11/2002 | Haag | A63B 21/0552 | 482/121 |
| 6,726,642 | B2 * | 4/2004 | Danielsson | A61B 5/0555 | 601/34 |
| 2004/0049135 | A1 * | 3/2004 | Callanan | A61H 1/024 | 601/33 |
| 2005/0003935 | A1 * | 1/2005 | Yamauchi | A61H 1/0218 | 482/79 |
| 2008/0032877 | A1 * | 2/2008 | Denisco | A61H 1/0244 | 482/145 |
| 2008/0254957 | A1 * | 10/2008 | Hazan | A63B 21/0552 | 482/140 |
| 2013/0197403 | A1 * | 8/2013 | Sevy | A63B 21/0442 | 601/5 |
| 2013/0203569 | A1 * | 8/2013 | Athis | A63B 21/0552 | 482/142 |

* cited by examiner

POLYVALENT APPARATUS FOR PHYSICAL THERAPY

BACKGROUND OF THE INVENTION

1) Field of the Invention

The present invention concerns a polyvalent apparatus for physical therapy. In particular, the present invention concerns a polyvalent therapeutic tooling suitable for post-surgery rehabilitation of a patient after colon-rectum surgery and for reducing his stay times in a bed.

2) Background Art

It is known to use therapeutic tooling adapted to re-establish the muscular tone of calf or leg muscles of a patient after colon-rectum surgery. It is also known to use tooling adapted to reactivate abdomen muscles of a patient without being subjected to contraction or excessive tensions. According to document EP-A1-2548542, a tool for the rehabilitation treatment of a person immobilised in a bed comprises a door-type structure equipped with at least one of: a traction bar suspended to the cross member, adapted to support in a lifted position the lower limbs of a persona in a supine decubitus; a movement accessory adapted to be engaged by a single-foot patient rest in supine decubitus. According to document DE-A1-2613533, an apparatus for the passive movement of the lower limbs comprises a walking tool, to whose pedals feet of a laying patient are fastened, actuated by an electric motor with a controlled number of revolutions per time unit.

A problem present in the field of physical therapy apparatus deals with the difficulty of making polyvalent therapeutic tooling, namely tooling capable of being transformed allowing to re-educate different muscular groups.

SUMMARY OF THE INVENTION

In view of the above prior art, object of the present invention is providing a polyvalent apparatus for physical therapy, capable of being transformed for housing a combination of different tools aimed to re-educate specific muscular groups.

According to the present invention, said object is reached by a polyvalent apparatus for physical therapy, comprising a support on which a tool provided for a specific treatment is fastened, wherein a second tool is connected to the support in combination with a first tool.

BRIEF DESCRIPTION OF THE DRAWINGS

The features of the present invention will be better clear from the following description of a practical embodiment thereof, provided as a non-limiting example in the enclosed drawings, in which.

DETAILED DESCRIPTION OF PREFERRED EMBODIMENTS

Figure 1:
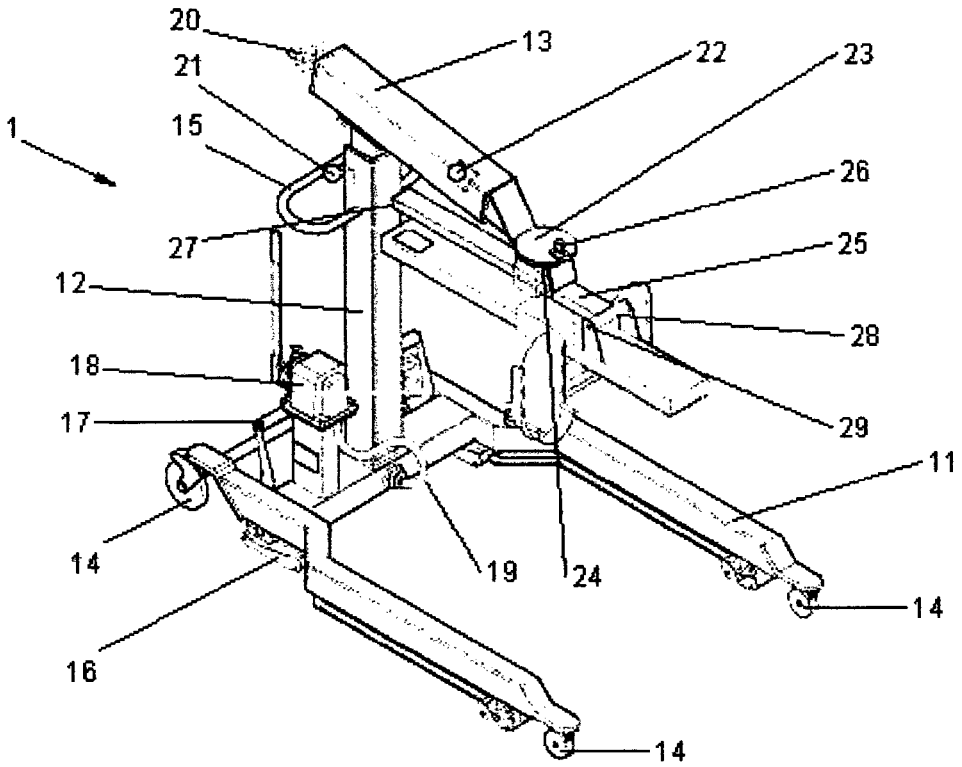
FIGS. 1, 2 and 3 show an axonometric view, a front view and a side view of a support of a polyvalent apparatus for physical therapy of the invention.
Figure 2:
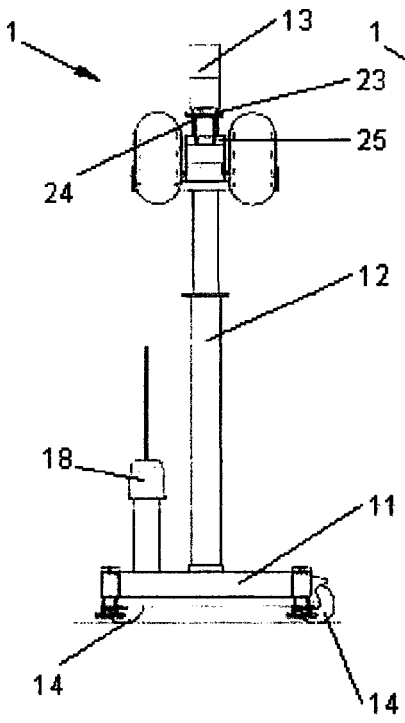
Figure 3:
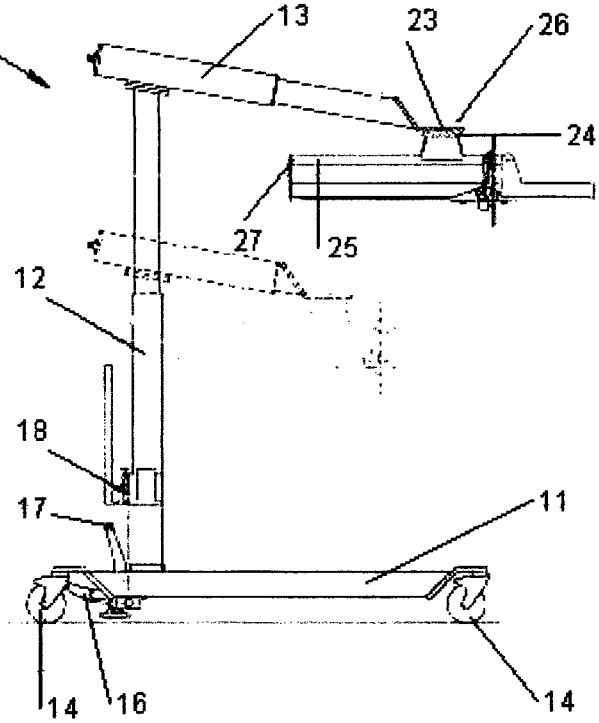
Figure 4:
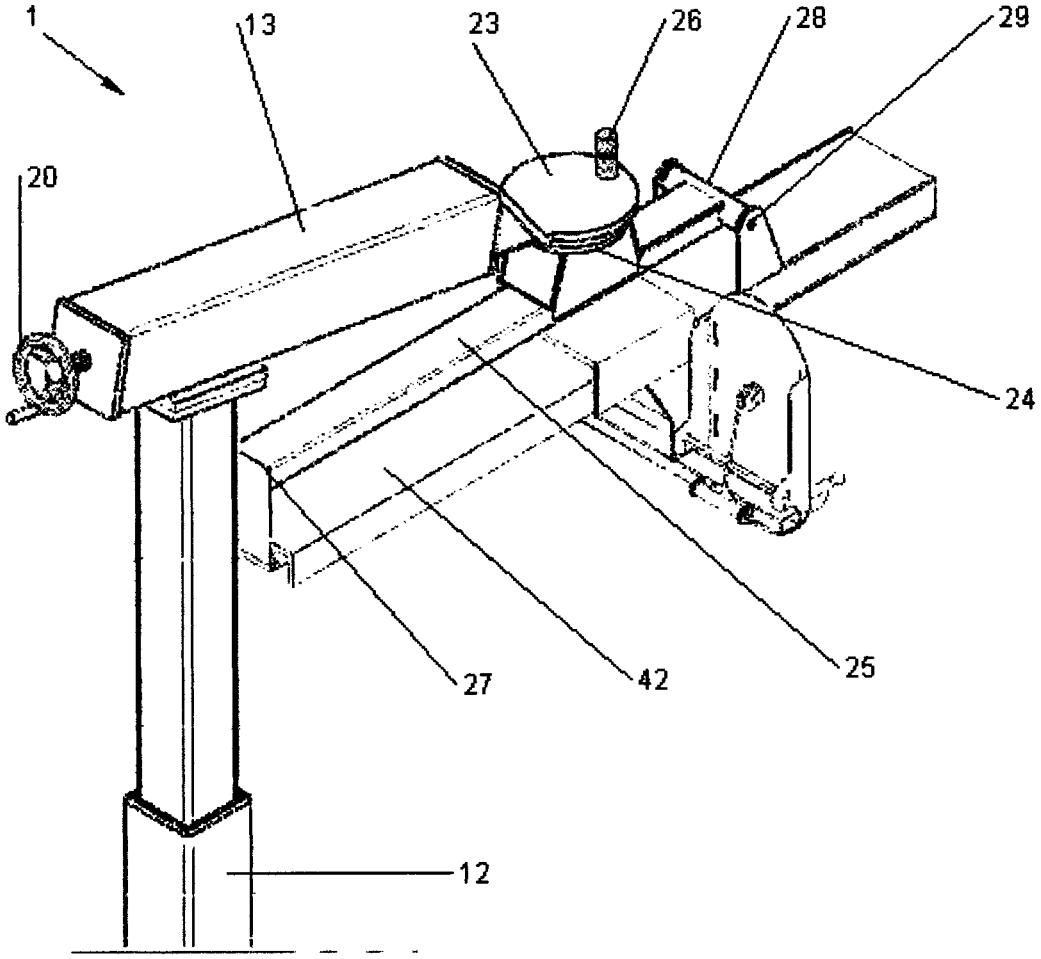
FIG. 4 shows an axonometric view of a pair of interface plates for rotating a beam around a vertical axis to the ground belonging to the apparatus of the invention.

With reference to FIGS. 1, 2, 3 and 4, a polyvalent apparatus for physical therapy comprises a support 1 composed of a metallic structure 11 surmounted by a telescopic tower 12 with an inclined arm 13 to which a specific tool provided for treating a patient is fastened.

To the base of the metallic structure 11 four wheels 14 are fastened, free of rotating, capable of being oriented and blocked, which allow an easy displacement of the polyvalent apparatus along pathways of an hospital; the displacement is ensured by a big handle 15 integral with the tower 12. The wheels 14 are equipped with braking devices 16 actuated by a transverse bar 17 to guarantee a correct and solid installation to the edges of the patient's bed.

The telescopic tower 12, integral with the metallic structure 11 and centrally placed with respect thereto, can be extended through an oil-dynamic pump 18 connected to an hydraulic piston through a pipe 19.

The inclined arm 13 is telescopic and manually elongated by acting on a flywheel 20 placed on the head of the arm 13 itself. The tower 12 and the inclined arm 13 are equipped with a respective screw-type knob 21, 22 to block the stroke of the hydraulic piston (not shown) placed inside the tower 12 and of the screw-lock screw assembly (not shown) inside the inclined arm 13.

The projecting end of the inclined arm 13 is provided with an upper interface plate 23 connected to a beam 25 through a lower interface plate 24 integral with the beam 25. The pair of upper 23 and lower 24 interface plates allow rotating the beam 25 with respect to the inclined arm 13, around a vertical axis to the ground on which the apparatus rests. A pin 26 ensures locking the lower plate 24 with respect to the upper plate 23 next to certain positions rotated by a flat or right angle.

The manual rotation is allowed by unlocking the pin 26.

The ends of the beam 25 are occupied by a head plate 27, equipped with threaded interface holes (not shown), and with a sleeve 28 crossed by a cylindrical bore 29.

The support 1 bears specific tools for physical therapy by means of the beam 25.

A first tool 4 is used for performing the exercise of training with weights, exercise known as "press leg", wherein the patient pushes a weight or contrasts a resistance with his leg's force.

With reference to FIGS. 5 to 9, the first tool 4 is composed of a linear sliding guide 41 supported by carter 42 connected to the beam 25 through a end plate 43 coupled with the plate 27 and through a pair of wings 44 equipped with through-hole which can be coupled with the hole 29 of the sleeve 28.

Figure 7:
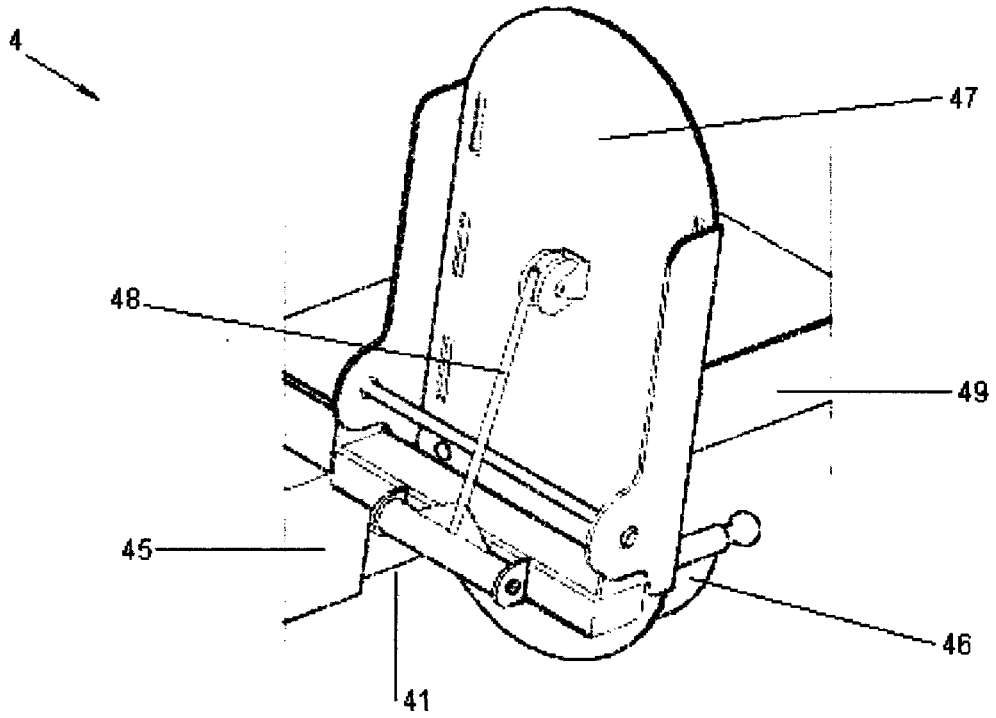
FIG. 7 shows an axonometric view of an anatomic housing and of an oscillating profile belonging to the first tool of FIG. 5.
Figure 8:
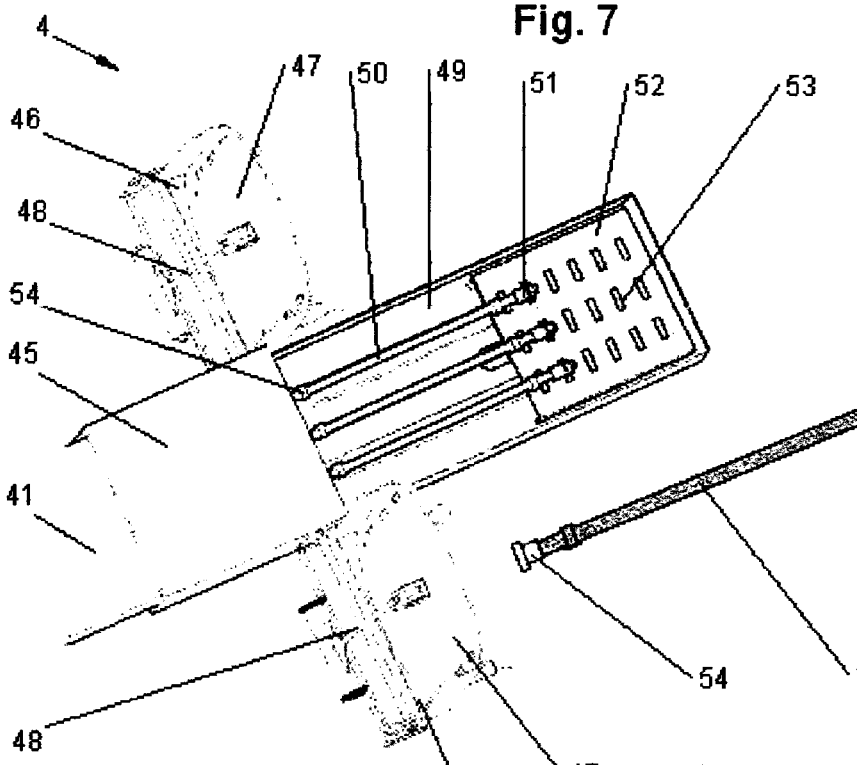
FIGS. 8 and 9 show an axonometric view of a box containing a group of elastic bands belonging to the first tool of FIG. 5.
Figure 9:
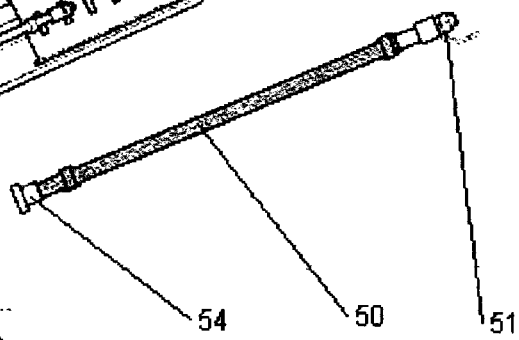

The linear sliding guide 41 is traveled by a slider 45 connected to a pair of anatomic housings for heels 46, over which there are two oscillating shapes 47 which allow flexure-extension movements of the tibia-tarsus articulation by means of an elastic abutment 48 independently acting on each oscillating profile 47 (FIGS. 7, 8).

A projecting section of the carter 42 is connected to a box 49 capable of being lifted, containing a group of elastic bands 50. Each elastic band 50 operates as resistance to the thrust movement of the lower limbs, having an end 51 fastened to a fastening plate 52 equipped with connections 53 arranged at different heights to calibrate the tooling with a certain pre-load, and a mobile end 54 connected to the slider 45 (FIG. 8).

Figure 5:
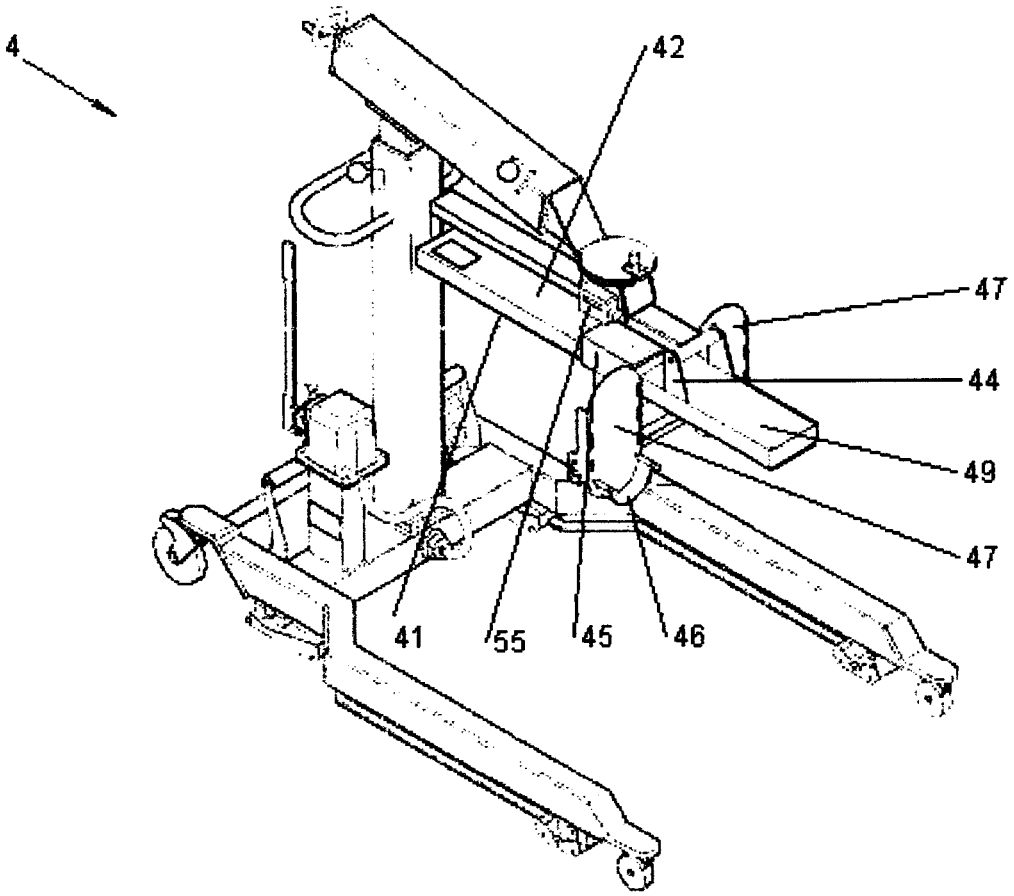
FIG. 5 shows an axonometric view of a first tool, used for performing a physical exercise, connected to the support of the apparatus of the invention.
Figure 6:
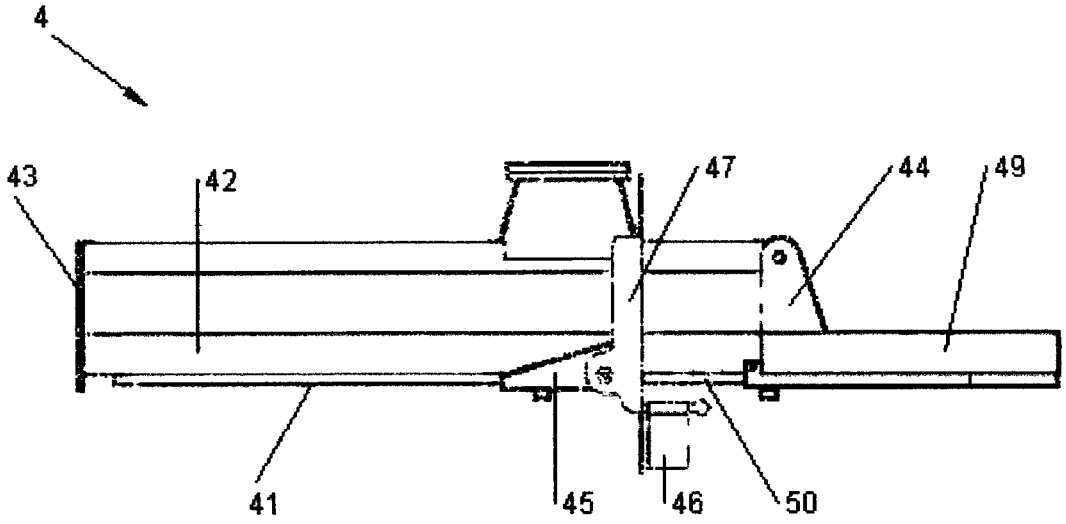
FIG. 6 shows a side view of the first tool of FIG. 5.

Immediately below the plate 25 there is a strike-counter 55 coupled with the first tool 4, for detecting repetitions in re-education operations (FIG. 5).

A second tool 6 is used for performing the exercise of resistance of formation of the quadriceps muscle in the legs, exercise known as "leg extension".

The second tool 6 is connected to the support 1 by means of the first tool 4 fastened to the beam 25, this latter one being rotated by a flat angle with respect to the configuration used for performing the exercise with the first tool 4, following: unlocking of pin 26; unlocking of lower plate 24 with respect to upper plate 23; manual rotation by 180° of beam 25; locking of pin 26.

Figure 10:
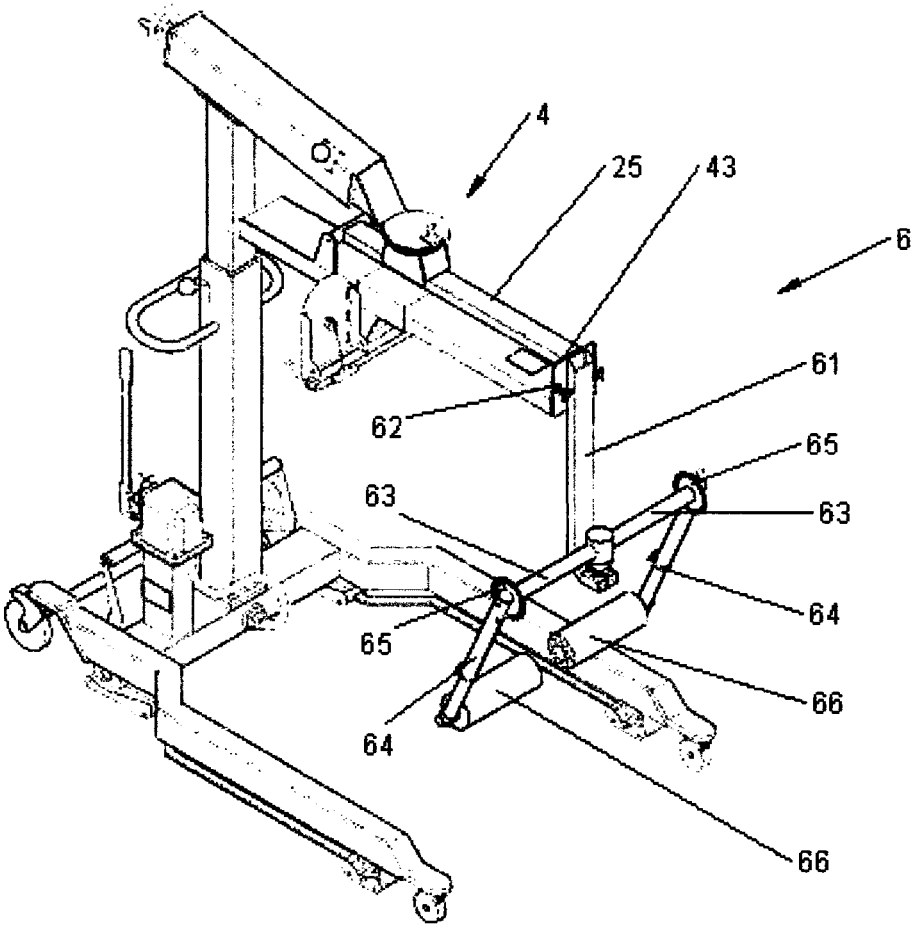
FIG. 10 shows an axonometric view of a second tool, used for performing a physical exercise, connected to the support and to the first tool.
Figure 11:
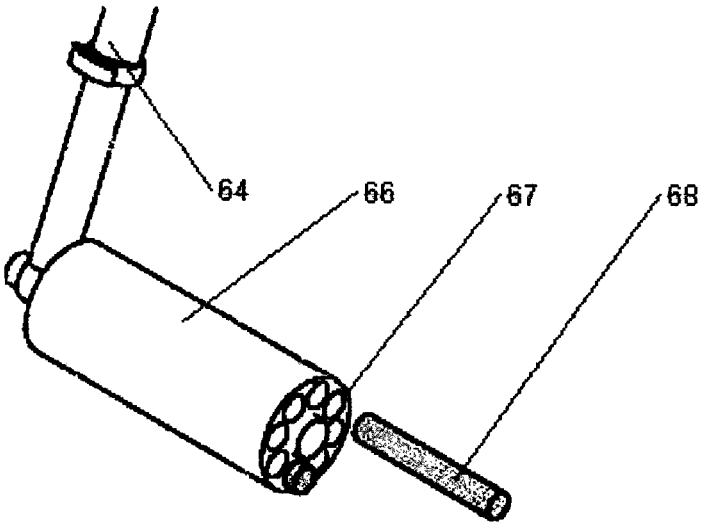
FIG. 11 shows an axonometric view of a part belonging to the second tool of FIG. 10.

With reference to FIGS. 10 and 11, the second tool 6 is composed of a vertical rod 61 ending with a plate 62 coupled with the end plate 43 of the first tool 4 through screw-type knobs. The vertical rod 61 operates as support for a horizontal bar 63, which is used as popliteal bearing for the patient's limbs. To the end of the bar 63, two telescopic arms 64 are connected, rotating with a device 65 which adjusts their movement amplitude. The projecting end of each arm 64 is equipped with a cylindrical device 66 which can be anatomically suited to the patient's foot back and equipped with seats 67 for housing a series of weights 68 necessary for changing the value of the resistance to be contrasted with the physical exercise.

A third tool 8 is used for performing the exercise of extending the affected limb keeping the eccentric contraction of the quadriceps, exercise known as "ECQ-Quadriceps Contraction Elastic Band".

The third tool 8 is connected to the support 1 by means of the first tool 4 fastened to the beam 25, this latter one being rotated by a flat angle with respect to the configuration used for performing the exercise with the first tool 4, following a manual procedure identical to the one seen for applying the second tool 6.

Figure 12:
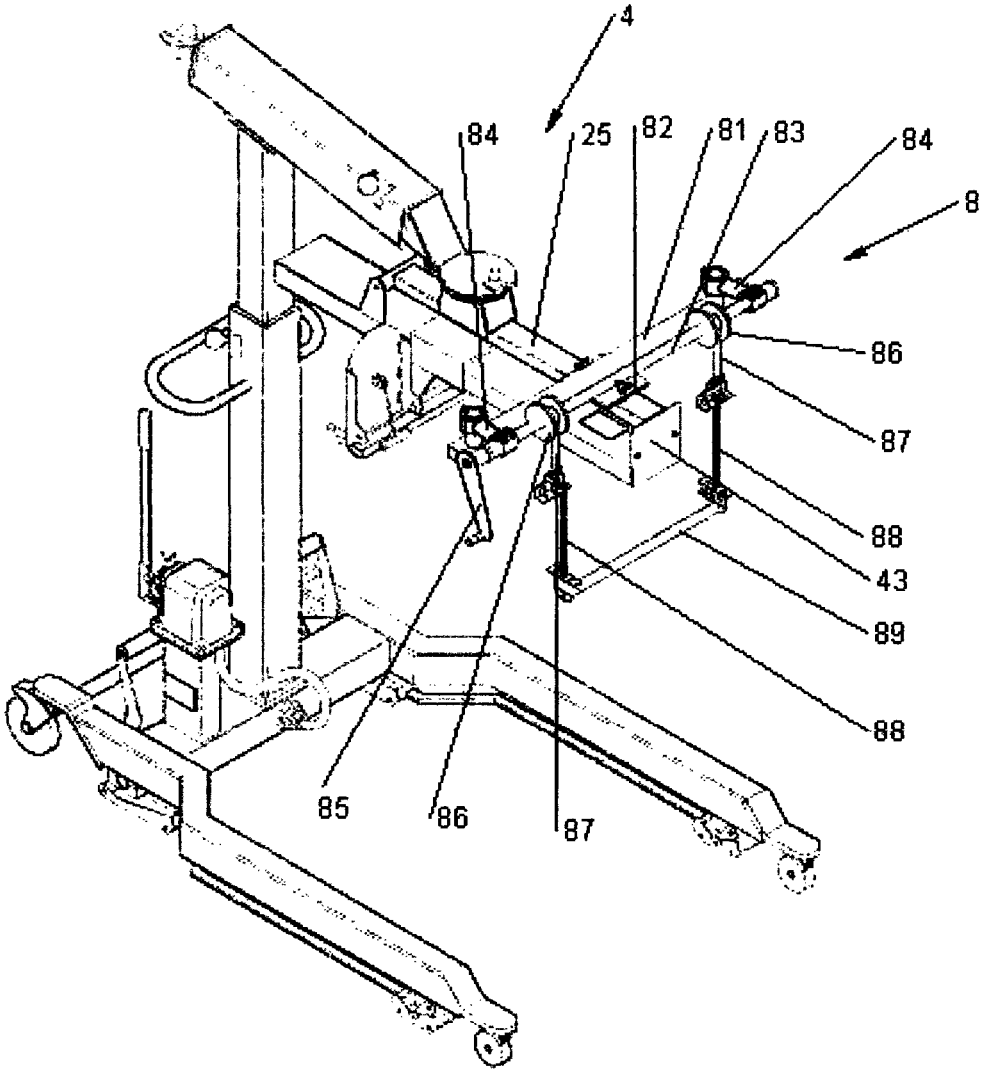
FIG. 12 shows an axonometric view of a third tool, used for performing a physical exercise, connected to the support and to the first tool.

With reference to FIG. 12, the third tool 8 comprises an horizontal supporting bar 81 integral with a central plate 82 directly fastened to the beam 25 though screw-type knobs. A shaft 83 is free of rotating in the seat obtained in two small arms 84 fastened to the end of the bar 81. The rotation of the shaft 83 is driven by a handle 85 lateral thereof; two winding coils 86 are keyed to the shaft 83, and wrap around a band 87 ending with an elastic section 88 connected to the end of a horizontal rigid bar 89, covered with a non-toxic rubbery material, which works as abutment for the user popliteal area.

The polyvalent apparatus for physical therapy performs the function of housing different tools used for re-educating specific muscle groups due to the rotation of the beam 25 and to the structural stiffness contribution given by the combination of two tools, 4-6 and 4-8.

A variation applied to the polyvalent apparatus for physical therapy of the invention respectively provides the second tool 6 and the third tool 8 directly connected to the rotated beam 25 and without using the first tool 4. In this case, the beam 25 must be sized to provide for the structural stiffness otherwise guaranteed by the combination with the first tool 4.

It is provided to motor the elongation of the telescopic parts, in particular the tower 12 and the inclined arm 13.

The polyvalent apparatus for physical therapy has been designed so that all parts in contact with the patient are protected by a material which can be easily interchanged and obtained inside hospitals (paper socks, tissues, etc.) in compliance with hygienic standards.

What is claimed is:

1. A polyvalent apparatus for physical therapy, comprising:

a support including a metallic structure surmounted by a telescopic tower with an inclined arm extending from the tower;

a press leg tool attached to the inclined arm by a rotatable mechanical interface apparatus, the press leg tool including:

an attachment beam attached to the rotatable mechanical interface apparatus, a linear sliding guide attached to the attachment beam, a slider movable on the linear slide guide, a box attached to the attachment beam, the box including a fastening plate equipped with fastening plate connections arranged at different heights to calibrate the press leg tool, and a group of elastic bands, each elastic band operating as resistance to slider movement, each elastic band having a first end fastened to a fastening plate connection, and each elastic band having a second mobile end connected to the slider, wherein a thrust movement causes the slider to slide on the linear slide guide, stretching the elastic bands;

a leg extension tool including:

a vertical rod attachable to the press leg tool attachment beam, a leg extension horizontal bar supported by the vertical rod, two rotating arms connected to ends of the horizontal bar, and a cylindrical device attached to each rotating arm, each cylindrical device equipped with seats configured to house various weights for changing resistance to movement of a respective rotating arm; and a quadriceps contraction elastic band tool including:

a horizontal supporting bar attachable to the press leg tool attachment beam, a rotatable shaft attached to the horizontal supporting bar, a horizontal rigid bar, two quadriceps bands connected between the rotatable shaft and the horizontal rigid bar, each quadriceps band including an elastic section, wherein the elastic section resists rotation of the rotatable shaft.

2. The polyvalent apparatus for physical therapy of claim 1, further comprising anatomic housings for heels attached to the slider, the housings having oscillating profiles which allow flexure-extension movements of tibia-tarsus articulation by means of an elastic abutment which acts independently on each oscillating profile.

3. The polyvalent apparatus for physical therapy of claim 1, wherein the attachment beam includes a head plate and a sleeve having a bore, the attachment beam being connected to the press leg tool by means of the head plate and the sleeve.

4. The polyvalent apparatus for physical therapy of claim 3, wherein the press leg tool further comprises:

the linear sliding guide connected to the attachment beam via an end plate attachable to the head plate; and a pair of wings, each having a through-hole oriented to allow coupling with the sleeve bore.

5. The polyvalent apparatus for physical therapy of claim 1, wherein the attachment beam is constructed to rotate by a flat angle with respect to a configuration used for performing an exercise with the press leg tool; and wherein the vertical rod ends with a leg extension tool plate coupled with the end plate of the Press Leg tool, the leg extension horizontal bar is configured as a popliteal bearing for limbs of a patient, and the rotating arms are telescopic.

6. The polyvalent apparatus for physical therapy of claim 1, further comprising:

wherein the attachment beam is constructed to rotate by a flat angle with respect to a configuration used for performing an exercise with the press leg tool, the horizontal supporting bar has a central plate fastened to the attachment beam, and the rotatable shaft is attached to the horizontal supporting bar by two arms, and further comprising:

a handle configured to rotate the rotatable shaft; and two winding coils being keyed on the rotatable shaft, the winding coils wrapping the quadriceps bands and wherein the horizontal rigid bar is covered with a non-toxic rubbery material, which operates as abutment for the popliteal area of the patient.

7. The polyvalent apparatus for physical therapy of claim 1, wherein the inclined arm is configured to telescope and further comprising an apparatus for telescoping the tower and the inclined arm via a motor.

8. The polyvalent apparatus for physical therapy of claim 2, wherein the mechanical interface apparatus further includes a pin for fixing the press leg tool at a specific angular position.

9. The polyvalent apparatus for physical therapy of claim 2, wherein the leg extension tool and the quadriceps contraction elastic band tool are fastened to an end plate of the press leg tool and to the beam through screw-type knobs.

* * * * *